United States Patent [19]

Marion

[11] 4,198,629

[45] Apr. 15, 1980

[54] NUMERICAL DISPLAY USING PLURAL LIGHT SOURCES AND HAVING A REDUCED AND SUBSTANTIALLY CONSTANT CURRENT REQUIREMENT

[75] Inventor: Roland M. Marion, LaFayette, N.Y.

[73] Assignee: General Electric Company, Syracuse, N.Y.

[21] Appl. No.: 803,574

[22] Filed: Jun. 6, 1977

[51] Int. Cl.[2] ..... G09F 9/32

[52] U.S. Cl. ..... 340/761; 368/241; 340/762; 340/782

[58] Field of Search ..... 340/336; 58/50 R

[56] References Cited

U.S. PATENT DOCUMENTS

| | | | |
|---|---|---|---|
| 3,146,436 | 8/1964 | Crow | 340/336 |
| 4,017,847 | 4/1977 | Burford et al. | 340/336 |
| 4,052,842 | 10/1977 | Beguin et al. | 58/50 R |

*Primary Examiner*—David L. Trafton

*Attorney, Agent, or Firm*—Richard V. Lang; Carl W. Baker

[57] ABSTRACT

The present invention relates to a numerical display having a reduced dc current requirement per character display site. The invention is applicable to a variety of numerical displays including seven segment and 4×7 matrix displays using light emitting diodes, and low voltage incandescent segmented units designed to replace light emitting diode displays. A practical application is for displaying time in an ac powered clock or clock radio in which it is desirable to keep the dc current requirement of the display to a substantially constant minimum suitable for use with a low cost, transformerless power supply conventional with radio receivers. The current requirement of a character display site is reduced over that of full parallel operation by selectively serializing certain light sources in a manner leaving the display control circuitry uncomplicated by permitting each light source state to be controlled by a shunt control switch sharing a common bus. Since a seven segment display may assume $2^7$ or 128 characters and only 10 (or 11) characters are used in a full numerical font, considerable control flexibility may be sacrificed by serial segment connection before any useful characters are eliminated. A display site having a full numerical font may be reduced from 7 to 4 branches and its current reduced 43% relative to full parallel operation under shunt control. Shunt control, which diverts, rather than prevents, current flow in the display, permits the display current to remain substantially constant irrespective of the numbers displayed. When the dc current drain of a time display is comparable to that of a radio and the ac component is tolerably low, the two may be serially connected without substantially increasing the dissipation over that of the clock or the radio alone.

8 Claims, 10 Drawing Figures

FIG.1A.
CHARACTERS:
0 1 2 3 4 5 6 7 8 9
SEGMENT STATES:
| SEGMENT POSITIONS: | 0 | 1 | 2 | 3 | 4 | 5 | 6 | 7 | 8 | 9 |
|---|---|---|---|---|---|---|---|---|---|---|
| a | 1 | 0 | 1 | 1 | 0 | 1 | 1 | 1 | 1 | 1 |
| b | 1 | 1 | 1 | 1 | 1 | 0 | 0 | 1 | 1 | 1 |
| c | 1 | 1 | 0 | 1 | 1 | 1 | 1 | 1 | 1 | 1 |
| d | 1 | 0 | 1 | 1 | 0 | 1 | 1 | 0 | 1 | 1 |
| e | 1 | 0 | 1 | 0 | 0 | 0 | 1 | 0 | 1 | 0 |
| f | 1 | 0 | 0 | 0 | 1 | 1 | 1 | 0 | 1 | 1 |
| g | 0 | 0 | 1 | 1 | 1 | 1 | 1 | 0 | 1 | 1 |
STATE "1" = ON STATE "0" = OFF
FIG.1B.
SEGMENT POSITION CHART:
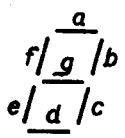
FIG.2.
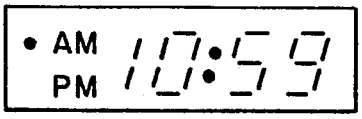
FIG.4.
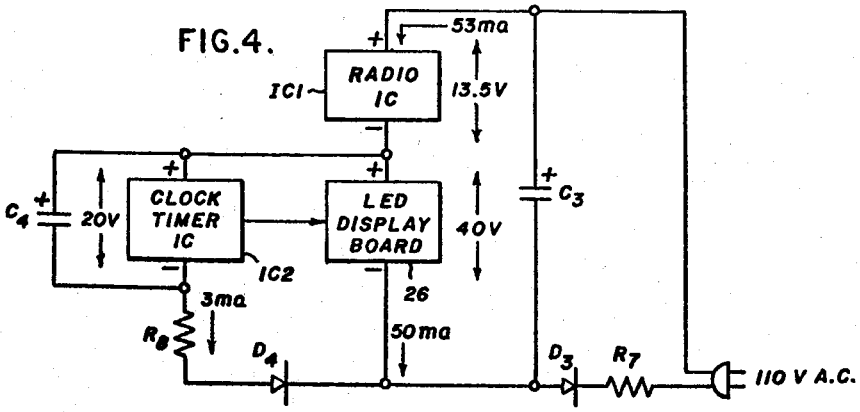

FIG.6.
4 X 7 LED DISPLAY FONT
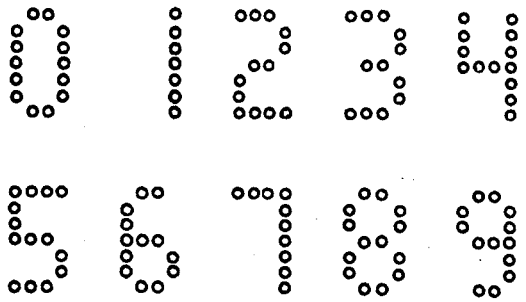
FIG.7A.
| DIODE POSITIONS | NUMERAL 0 | 1 | 2 | 3 | 4 | 5 | 6 | 7 | 8 | 9 |
|---|---|---|---|---|---|---|---|---|---|---|
| | DIODE STATES: (1=ON, 0=OFF) | | | | | | | | | |
| $a_1$ $a_2$ | 1 | 0 | 1 | 1 | 0 | 1 | 1 | 1 | 1 | 1 |
| 1 | 0 | 1 | 0 | 0 | 1 | 1 | 0 | 1 | 0 | 0 |
| $b_1$ $b_2$ | 1 | 1 | 1 | 1 | 1 | 0 | 0 | 1 | 1 | 1 |
| 2 | 1 | 1 | 0 | 0 | 1 | 0 | 0 | 1 | 0 | 1 |
| $c_1$ $c_2$ | 1 | 1 | 0 | 1 | 1 | 1 | 1 | 1 | 1 | 1 |
| 3 | 0 | 1 | 1 | 0 | 1 | 0 | 0 | 1 | 0 | 0 |
| $d_1$ $d_2$ | 1 | 0 | 1 | 1 | 0 | 1 | 1 | 0 | 1 | 1 |
| 4 | 0 | 0 | 1 | 1 | 0 | 1 | 0 | 0 | 0 | 0 |
| $e_1$ $e_2$ | 1 | 0 | 1 | 0 | 0 | 0 | 1 | 0 | 1 | 0 |
| 5 | 1 | 0 | 0 | 0 | 1 | 1 | 1 | 0 | 0 | 0 |
| $f_1$ $f_2$ | 1 | 0 | 0 | 0 | 1 | 1 | 1 | 0 | 1 | 1 |
| 6 | 0 | 0 | 1 | 1 | 1 | 1 | 0 | 1 | 0 | 0 |
| $g_1$ $g_2$ | 0 | 0 | 1 | 1 | 1 | 1 | 1 | 0 | 1 | 1 |
FIG.7B.
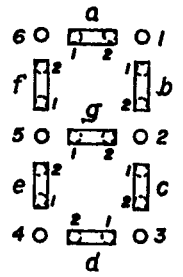
DIODE POSITION CHART
FIG.8.
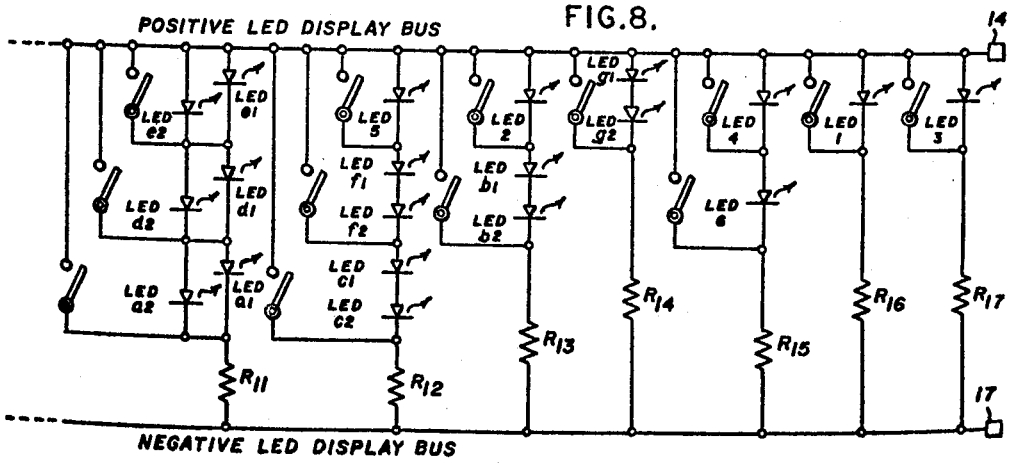

NUMERICAL DISPLAY USING PLURAL LIGHT SOURCES AND HAVING A REDUCED AND SUBSTANTIALLY CONSTANT CURRENT REQUIREMENT

BACKGROUND OF THE INVENTION

1. Field of the Invention

The present invention relates to numerical displays using plural light sources and more particularly to the energization and control circuits designed for such displays.

2. Description of the Prior Art

Visual displays consisting of characters which are formed by the energization of various point or line element combinations are now quite common. Such alpha-numeric displays include the older incandescent lamp matrix scoreboards and time and temperature displays as well as newer displays using light emitting diodes. One format used frequently is a 5×7 rectangular matrix of points ($2^{35}$) which has over 34 billion potential characters of which less than 100 are normally useful, assuming both letters and numbers are to be displayed. As digital readouts find more applications and continue to displace analog displays, there occur many instances of strictly numerical fonts which require only eleven characters or less (depending on the need to generate a zero and a blank). Since four binary elements are sufficient to generate sixteen characters (e.g. hexadecimal code), it is quite inefficient to employ seven elements having 128 possibilities merely to generate these few numerals. Consumers demand a familiar font and firmly reject the use of a number system based on 16 instead of 10, so the seven line segment format is particularly popular.

The energization of a seven segment display site can be accomplished by connecting the display element branches in parallel and turning off each element by means of a shunt switch causing current diversion. The current for a site is seven times that of a single segment and it does not vary greatly with the number of segments excited since the current diverted from a segment flows in the shunt switch. (Although series control by current interruption is frequently used, thereby effecting significant dc current reduction, it is normally impractical to provide sufficient smoothing of the ac component for compatibility with either the desired transformerless power supply or a serially connected radio receiver.) Each element conventionally consists of a single light emitting diode creating a single visible line segment. Serial stacking of seven LED diodes (for one character site) with a shunting bipolar transistor on each segment is normally impractical. Since PNP devices would require much more area in an integrated form in order to handle the current for conventional LEDs, NPN devices would be preferred. Assuming NPN devices, the number of LEDs stacked must normally be limited to avoid breaking down the emitter-base junction of the top transistor device when all other segments are "on". Five LEDs at 1.8 volts each stack to 9.0 volts, a voltage which exceeds the maximum for most integrated NPN transistors. Thus, full serial partitioning of one character by stacking seven diodes and using bipolar control transistors is normally precluded. Although a reverse current limiting diode could be employed in conjunction with each NPN, this approach would remain incompatible with single-chip integration in the lowest cost batch fabrication technique currently in widespread use for production of line operated clock-/timer ICs: MOS.

If MOSFET control devices are employed with a full serial LED arrangement, there are comparable disadvantages which lead generally to adverse variations in brightness. The saturated MOS drain current is strongly dependent on the gate-to-source voltage, and the latter is difficult to control in the stacked arrangement. The conduction states of segments lower in the stack create a wide dynamic range of source voltages for the upper MOS switches. If brightness is controlled by current amplitude, the problems are further compounded.

In some display applications (e.g. line operated digital clocks and clock radios having LED readouts) a line transformer contributes significantly to the total product cost. An approach which would reduce total display current without sacrificing brightness or introducing an excessive ac current component would allow a smaller, less expensive transformer or eliminate it altogether. In many cases, the transformer could be omitted without increasing the cabinet dissipation beyond acceptable limits.

SUMMARY OF THE INVENTION

Accordingly, it is an object of the invention to provide an improved light emitting diode display network for a single display site.

It is a further object of the present invention to provide an improved numerical display using plural light sources.

It is still another object of the present invention to provide a numerical display network which requires reduced current for a single display site and uses shunt control.

It is a further object of the present invention to provide a novel transformerless energization circuit for a clock radio using light emitting diodes at four display sites for time indication.

These and other objects of the invention are achieved in a combination comprising controllable LED numerical display sites and energization and control networks for those sites. A display site displays one numerical character through a full or partial numerical font and contains a plurality of light emitting diodes at positions "a" to "g" respectively, on a vertically elongated parallelogram with a central horizontal bar, the positions being identified as follows:

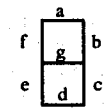

The diode energization and control network comprises polarized first and second input terminals for connection to a unidirectional source, and a plurality of mutually parallel energization and control branches connected between the input terminals. Each branch includes a current stabilizing means, one or more forward poled diodes, and one or more switches, each returned to the second input terminal. Taken one branch at a time, the first branch includes a first stabilizing means and diodes in positions a and d connected respectively between the first and second input terminals, and a first switch shunting diodes in positions a and d, whereby a diode in position d is never on without a diode on in position a. The second branch includes a second current stabilizing means and diodes in positions c and f connected respectively between the first and second input terminals, and two switches; one shunting diodes in positions c and f, and the other shunting the diode in position f, whereby a diode in position f is never on without a diode on in position c. The third branch includes a third current stabilizing means and a diode in position b connected respectively between the first and second input terminals, and a fourth switch shunting the diode in position b. The fourth branch includes a fourth current stabilizing means and a diode in position g connected respectively between the first and second input terminals, and a fifth switch shunting the diode in position g.

When the display site is restricted to numerals from 0 to 5, the first branch requires only a single switch shunting diodes in positions a and d, since the diodes in positions a and d are on or off together. In the same 0–5 display, the third branch includes a diode in position e connected between the diode in position b and the second input terminal, and two switches are provided, one shunting both diodes in position b and e, and the other shunting the diode in position e. The configuration causes the diode in position e never to be on without a diode on in position b.

When the display site is for numerals 0 to 9, the first branch includes a diode in position e connected between the diode in position d and the second input terminal. The first branch also requires three switches, one shunting diodes in positions a, d and e, the second shunting diodes in positions d and e, and the third shunting the diode in position e. The configuration causes the diode in position e never to be on without a diode on in position d, and the diode in position d never to be on without a diode on in position a.

In the most common display, there is one diode in each position, producing a light in a bar shape. However, the invention is also applicable to arrangements in which two or perhaps three diodes occupy each position. In a so-called 5×7 display, a diode is provided at each numbered position on the parallelogram, identified as follows:

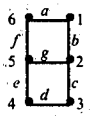

In the diode energization and control network the second branch includes a diode in position 5 connected in series between the diode in position f and said second input terminal. The second branch also includes a switch shunting diodes in positions c, f and 5, a switch shunting diodes in positions f and 5, and a switch shunting the diode in position 5. The configuration causes the diode in position 5 never to be on without a diode on in position f, and the diode in position f never to be on without a diode on in position c. The third branch includes a diode in position 2 connected in series between the diode in position b and the second input terminal, a switch shunting diodes in positions b and 2, and a switch shunting the diode in position 2. The configuration causes the diode in position 2 never to be on without a diode on in position b. An additional fifth branch includes a fifth current stabilizing means and diodes in positions 6 and 4 connected respectively between the first and second input terminals, and a switch shunting diodes in positions 6 and 4, and a switch shunting the diode in position 4. The configuration causes a diode in position 4 never to be on without a diode on in position 6. An additional sixth branch includes a sixth current stabilizing means and a diode in position 1 connected respectively between the first and the second input terminals, and a switch shunting the diode in position 1. An additional seventh branch includes a seventh current stabilizing means and a diode in position 3 connected respectively between the first and the second input terminals, and a switch shunting the diode in position 3.

In a transformerless clock radio, the LED display may be connected in series with a radio chip, and the two energized in series by a single lower power dc supply. In this application, the LED time display has four character display sites for displaying minutes, tens of minutes, hours and tens of hours, and the first three of the display sites may each contain seven light emitting diodes at the previously identified positions "a" to "g" respectively. The energization network for the four display sites has polarized first and second input terminals, with each of the three display sites having four mutually parallel energization branches connected between the input terminals. Each branch includes a current stabilizing means, and one to three forward poled serially connected light emitting diodes designed to be selectively de-energized by shunt switches. The energization network has a predetermined voltage requirement. The current requirement is substantially equal to that of twelve light emitting diodes irrespective of the characters displayed or the brightness adjustment. The radio integrated circuit also has a predetermined voltage requirement and a current requirement approximating that of the diode energization network. Under these conditions, the dc power supply can consist of a half wave rectifier, a filter capacitor and a voltage dropping resistor conventional to transformerless radio receivers. The diode energization network and the radio integrated circuit are serially connected across the dc power supply, and the circuit is adjusted such that the output voltage of the supply is substantially equal to the sum of the voltage requirements of the energization network and the radio integrated circuit at the required current. The serial connection of the radio and the clock display, when the two have comparable current drains, causes no additional power dissipation over that of the clock or the radio alone.

A clock timer integrated circuit, normally requiring a much smaller current than the LED energization network, may be connected either directly across the dc power supply or in shunt with the LED energization network.

The invention is applicable to a variety of displays including those using incandescent units having voltage and current ratings comparable to light emitting diodes.

BRIEF DESCRIPTION OF THE DRAWINGS

The novel and distinctive features of the invention are set forth in the claims appended to the present application. The invention itself, however, together with further objects and advantages thereof may best be understood by reference to the following description and accompanying drawings, in which:

FIG. 1A illustrates a ten character numerical font, using seven display segments and includes a table of segment states corresponding to each character, and FIG. 1B is a segment position chart for the seven segment display;

FIG. 2 illustrates a seven segment display having four numerical character sites, a colon, and an AM/PM indication for displaying time;

FIG. 4 is a block diagram of a clock radio utilizing a seven segment display in which additional voltage is allocated to the display network to achieve greater constancy in display brightness;

FIG. 6 illustrates a ten character numerical font produced by a 4×7 LED display;

FIG. 7A is a table of diode states of the 4×7 display corresponding to each numeral, and FIG. 7B is a diode position chart for the 4×7 display; and FIG. 8 is an electrical circuit diagram for part of a 4×7 LED display which shows one character site capable of producing a 0 to 9 numerical font.

DESCRIPTION OF A PREFERRED EMBODIMENT

Figure 3:
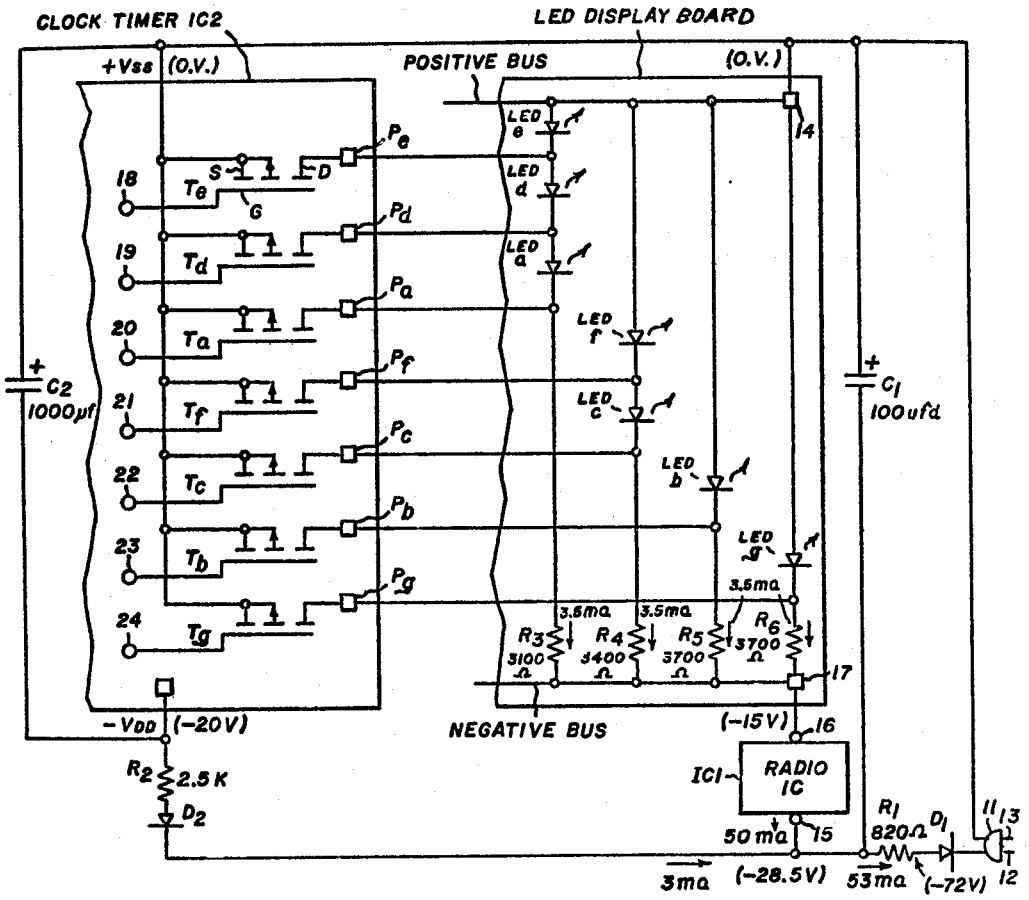
FIG. 3 is an electrical circuit diagram for one character site of a seven segment LED display, the display being a part of a clock radio.

Referring now to FIG. 1A, a ten character numerical font suitable for an electrically illuminated time display is shown. Each character in this commonly used font may be created by selective illumination of two or more of the seven line segments which constitute the display site. (Selection of none of the segments produces a null character, which may be considered as a useful eleventh character of the font.) While other light sources are known, each of the seven line segments may be illuminated by the emissions of one or more light emitting diodes (LEDs). Assuming LED illumination, the design of the individual segments often involves additional optical hardware such as lenses, reflectors, filters, fiber optics and opaque stops. These measures achieve greater size and contrast. The line segments ("segments") may be of approximately equal length, and are designed to be of equal brightness when lit and to be non-visible when unlit.

The seven segments for each character display site are distributed about a vertically elongated parallelogram with a horizontal segment near the center. For enhanced readability, the parallelogram may be skewed slightly, typically 8 to 10 degrees. As indicated in the segment position chart of FIG. 1B, the uppermost horizontal segment is marked "a", and the others, continuing clockwise around the parallelogram, bear the letters b, c, d, e, f, respectively, with the horizontal segment at the center being designated "g". By selectively illuminating the segments a through g, as illustrated in the table of FIG. 1A, the numerals 0 to 9 may be selectively displayed. In the table, the lighted or "on" state of a segment is indicated by a "1", and the unlighted or "off" state by a "0".

In the font illustrated in FIG. 1A, the following arbitrary choices have been elected according to common usage. The "zero" is an upper case zero, obtained by lighting segments a through f, and leaving g unlit. The "one" is a right-hand "one" with segments b and c on, the others off. The numerals "two", "three", "four", "five" and "eight" are conventional, and are not commonly formed in a variant manner. The "six" in the illustrated font has six segments with a top (a) segment present. A five segment "six" is also known with the top (a) absent. The "seven" in the illustrated font has three (a b c) segments on and the others off, although a four (a b c f) segment "seven" is also known. The "nine" is also a six segment figure, with the bottom (d) segment present. A known variation is a five segment "nine" with the bottom (d) segment absent.

A seven segment time display having four numerical character sites is shown in FIG. 2. For the purpose of displaying time, two of the four character sites require programming through a full font, and two through a partial font. The minutes portion of the display requires a units character which may have values from 0 to 9, and a tens character, which may have values from 0 to 5. The hours portion of the display requires a units character which may have values from 0 to 9 and a tens character which has zero (or blank) and one values. A colon is used to separate the hours from the minutes (or, optionally, the minutes from the seconds) to improve the readability of the display. Normally, a non-numerical indicator for AM and PM is provided. If a 24 hour display is provided, the AM-PM indication is unnecessary, and the tens of hours character site is allowed to be zero (or blank), one, or two. In the event that the display is used for the tuning dial of an AM radio, the rightmost site (the least significant character) may show a zero continuously, while the second and third sites may be programmable from 0 to 9. The leftmost site (the most significant character) may show zero (or blank), or one. With a multipurpose display, all sites may be required to be programmable through a complete numerical font.

The energization and control circuit for a full font LED character site is shown in FIG. 3. The drawing shows the principal blocks of a clock radio which uses the display. The energization and control circuit comprises a load circuit including an LED display and the current distribution circuitry principally located on the LED display board, a timer chip (IC2) for controlling the display, an integrated circuit radio chip (IC1), and an ac line operated transformerless dc power supply.

In FIG. 3, the LED display for a single character site is shown in circuit symbolism and the current distribution circuitry for that site is shown. Each of the segments a through g for one site of the display is electrically represented as a single diode ($LED_a$ to $LED_g$). A small arrow is associated with each of these diodes to denote the light emitting property. The diodes are polarized in the direction indicated by the diode symbol and are designed to give off light when sufficient forward bias (normally between 1.3 and 2 volts) is present. While operable from a battery source, the light emitting diodes may also be energized by a half wave rectified ac waveform with or without filtering. The current distribution network for the light emitting diodes of each character site consists of four parallel branches or current paths. Each branch consists of a series string of from one to three light emitting diodes poled in the direction of easy current flow, and a large series connected impedance which acts to stabilize the current in the branch.

The LED control circuit shown in FIG. 3 is contained in an integrated circuit (IC2). The integrated circuit is a part of a clock timer designed to derive timing information from the 60 cycle power line by means not shown, and to provide a binary control output for the LED display at seven pads ($P_a$ to $P_g$). The clock timer chip (IC2) is of the p-MOS process, and requires a $-20$ volt drain supply potential ($-V_{DD}$) referenced to a nominally 0 volt source supply potential ($V_{SS}$). A succession of seven p-MOS field effect transistors ($T_a$ to $T_g$) located on the clock timer chip and all having their sources coupled to the common $V_{SS}$ supply bus, provide the seven binary control outputs. These field effect transistors act as shunting switches for the LED display segments, responding to a translated timing signal available at the internal terminals (18 to 24).

The transformerless dc source in the FIG. 3 arrangement is energized from a conventional 110 volt ac power main and includes a half wave rectifier $D_1$, a voltage dropping impedance $R_1$ and a filter capacitor $C_1$. An integrated circuit chip (IC1), which contains the active circuitry of a radio receiver, forms a virtual second voltage dropping impedance for the display. In addition, a second diode $D_2$, a series resistance $R_2$ and a large (1000 μfd) "hold up" capacitor $C_2$ are provided for the timer chip.

The dc source is connected as follows. The dc source is coupled to a 110 volt 60 (or 50) hertz ac main by means of the plug 11. One pin 12 of the plug is connected through the line cord to the cathode of the rectifier diode $D_1$ and the other pin 13 is connected through the line cord to the $+V_{SS}$ pad on IC2 and to the pad 14 connected to the positive LED display bus on the LED display board. The pin 13 is of nominally zero potential and by connection to the $V_{SS}$ pad and to the pad 14 becomes the positive source terminal for the timer chip and the LED display board. The voltage dropping resistance $R_1$ connects the pad 15 on the radio chip (IC1) to the anode of diode $D_1$, which draws rectified current from the load and thus provides the negative bias connection to the radio chip (IC1). The serial order of the diode $D_1$ and the resistance $R_1$ may be reversed, particularly where the resistance is "fusible" to self-destruct on overload. The positive bias pad (16) on the radio chip (IC1) is connected to the pad 17 connected to the negative LED display bus for serial connection of the LED display circuit and the radio chip (IC1) across the dc source. The large (100 μfd) filter capacitor $C_1$ is coupled between the negative pad 15 on IC1 and the positive LED display pad 14 (also pin 13). The positive terminal of the capacitor $C_1$ may optionally be coupled to the positive pad 16 on the radio IC, in which event the voltage applied to the radio (IC1) is filtered by a lower cost capacitor having a lower voltage rating and the LED supply is left unfiltered. The path for dc energization of the clock timer chip IC2 is completed through the diode $D_2$, whose cathode is coupled to the negative radio pad 15, and whose anode is coupled through resistance $R_2$ to the $-V_{DD}$ pad on the clock timer chip.

The dc source supplies low voltage bias to the LED display, the radio chip (IC1), and the clock timer chip (IC2). The LED display and the radio chip are serially connected across the source. The clock timer chip (IC2) is connected in shunt with the two using a voltage dropping resistor $R_2$. The anode of diode $D_1$ assumes a negative polarity in respect to the voltage at the pin 13, which is the common load connection. With a current drain of 53 milliamperes, this voltage is about $-72$ volts (ave.). The 820 ohm resistance $R_1$ produces a further drop of about 43.5 volts, so that a 28.5 volt potential difference appears at the negative radio IC pad 15 with respect to the positive display bus and common load connection. The radio chip draws approximately 50 milliamperes at a fixed voltage drop of 13.5 volts. This drop is held substantially constant due to an internal voltage regulation circuit including a zener diode. The LED display is also designed to conduct a substantially equal, 50 milliampere, current at the 15 volt potential difference remaining between the negative LED bus and the positive LED bus. The dc source provides three milliamperes of current at 20 volts to energize the clock timer chip IC2 between its $+V_{SS}$ and $-V_{DD}$ pads. Resistance $R_2$ and the diode $D_2$ produce an approximately 8.5 volt drop at 3 milliamperes from the 28.5 volts available at pad 15 of IC1 with respect to the common load connection. The diode $D_2$ prevents the "hold up" capacitor $C_2$ from being discharged by the display when short term voltage drops occur on the ac line.

Each site of the LED display is energized by the dc potential applied between the LED display buses (i.e. at pads 14 and 17). As noted, the LEDs for each full font site are arranged in four parallel branches, each branch including a large current stabilizing impedance. The first branch comprises the three light emitting diodes $LED_e$, $LED_d$ and $LED_a$ and a current stabilizing, 3100 ohm resistance ($R_3$). The anode of diode $LED_e$ is coupled to the positive LED display bus, while its cathode is coupled to the anode of $LED_d$. The cathode of $LED_d$ is coupled to the anode of $LED_a$, and the cathode of $LED_a$ is coupled through resistance $R_3$ to the negative LED display bus. The second branch comprises the two light emitting diodes $LED_f$ and $LED_c$ and a current stabilizing, 3400 ohm resistance ($R_4$). The anode of diode $LED_f$ is coupled to the positive LED bus while its cathode is coupled to the anode of $LED_c$. The cathode of $LED_c$ is coupled through resistance $R_4$ to the negative LED bus. The third branch comprises the light emitting diode $LED_b$ and a current stabilizing, 3700 ohm resistance ($R_5$). The anode of the diode $LED_b$ is coupled to the positive LED bus, and its cathode is coupled through resistance $R_5$ to the negative LED bus. The fourth branch comprises the light emitting diode $LED_g$ and a current stabilizing, 3700 ohm resistance ($R_6$). The anode of the diode $LED_g$ is coupled to the positive LED bus and its cathode is coupled through resistance $R_6$ to the negative LED bus. Assuming that all seven light emitting diodes in this site are lighted (as when an "eight" is displayed), each diode will draw approximately 3.5 milliamperes and produce a voltage drop of approximately 2 volts. The maximum power consumption approximates 7 milliwatts per display segment, or 49 milliwatts per display site. The resistances $R_3$, $R_4$, $R_5$ and $R_6$ are designed to provide an approximately equal current in each segment.

The foregoing four branch energization configuration permits any one of the full 0 to 9 font or a blank, if it is desired, for the display character. Control over the excitation of the seven light emitting diodes of a single display site is achieved by the control circuit located on IC2. The control requirements of the LED display are not complicated by the consolidation of the energization circuit into four branches. Each of the seven LED diodes in a display site requires the same polarity and magnitude of switching signal. In addition, the control circuit, provided that all control signals can be complemented simultaneously, may be of the type that is usable for either series or shunt control.

The control circuit for the LED display comprises the seven MOSFET transistors ($T_a$ to $T_g$) formed on the timer chip (IC2) and responding to binary states existing at the internal terminals 18 to 24 of the timer chip. By shunt current control, these transistors force on and off states for individual segments, as indicated in FIG. 1A, to produce the individual numerals of the font. The FET control transistors ($T_a$ to $T_g$) are all formed on a P-channel chip with their sources all connected to the source bus ($V_{SS}$) at a nominal 0 volts. As previously noted, the ($V_{SS}$) source bus is coupled via the pad 14 to the positive LED bus and via the positive LED but to the uppermost LED anode of each of the four energization branches (i.e., the anodes of $LED_e$, $LED_f$, $LED_b$, $LED_g$). In short, the sources of all the FET control transistors ($T_a$ to $T_g$) are connected together and to the anodes of $LED_e$, $LED_f$, $LED_b$ and $LED_g$, also connected together. The drains of the FET control transistors ($T_a$ to $T_g$) are connected respectively to the pads ($P_a$ to $P_g$) on the timer chip (IC2) and these pads are in turn coupled to the cathodes of the respective light emitting diodes ($LED_a$ to $LED_g$). The gates of the control transistors ($T_e$, $T_d$, $T_a$, $T_f$, $T_c$, $T_b$, $T_g$) are connected respectively to the internal control terminals 18 to 24. The gate control circuitry is designed to produce binary operation of the FET control transistors between high conduction and near-zero conduction states.

The FET control transistors effect a shunt control of the display light emitting diodes. The shunt control operation in the simplest form may be explained by reference to the light emitting diode $LED_g$. The anode of this light emitting diode is coupled to the positive LED display (pad 14) which is also coupled to the $V_{SS}$ pad on the clock timer chip. The control transistor $T_g$, associated with $LED_g$, which is coupled through a current stabilizing impedance $R_6$ to the negative LED display pad 17, if off, allows the lighted LED to drop 1.3 to 2 volts. If the control transistor $T_g$ becomes conductive, the drain potential approaches the source potential and the cathode potential across the LED approaches, but does not reach, zero volts. The reduction in voltage across the light emitting diode reduces its conduction to a low value thereby extinguishing its visible light emission. The current which had previously been flowing in the light emitting diode is now mostly diverted to the control transistor. In the normal case of imperfect current stabilization, including the simple resistor/low voltage circuit of FIG. 3, the control transistor may conduct more current than was flowing through the "on" diode, while at the same time leaving a finite but negligible current flowing through the "off" diode. Essential to shunt operation is that the control transistor have an adequately low saturation voltage (drain current x channel resistance product) to reduce the light output of the light emitting diode below the visible threshold.

Shunt control of the light emitting diode $LED_g$ (in the fourth branch) is duplicated in the light emitting diode $LED_b$ in the single diode third branch, but is modified for the diodes in the plural diode branches. For instance, the diodes $LED_c$ and $LED_f$ in the second branch are connected in a series "string". If the control transistor $T_c$ becomes conductive, it will bring the potential drop across both diodes $LED_c$ and $LED_f$ below the visible threshold, turning off both together. If the control transistor $T_f$ becomes conductive, it will bring only the potential drop across diode $LED_f$ below the visible threshold. The diodes $LED_a$, $LED_d$ and $LED_e$ are subject to a similar mode of control. If the control transistor $T_a$ becomes conductive, it will bring the potential drop across all three diodes $LED_a$, $LED_d$ and $LED_e$ below the visible threshold, turning off all three. If the control transistor $T_d$ becomes conductive, it will turn off both diodes $LED_d$ and $LED_e$. If only control transistor $T_e$ becomes conductive, it will turn off diode $LED_e$ alone. The configuration tends to relax the saturation voltage specification for control transistor $T_a$ which may result in a smaller device and, ultimately, lower production costs. This is also true (to a lesser degree) of control transistors $T_d$ and $T_c$.

The four parallel energization and control branches permit display of a full 0 to 9 font (including a blank) and, although many non-numeric characters are precluded, do so without complication of the control logic. The immediate benefit of partial serialization of the seven diodes at a character site into four branches is a reduction in the current drain by about 43% relative to a conventional seven branch all parallel configuration. The seven segments of an individual character site are capable of $2^7$ or 128 different character compared to the 11 useful characters (including the null character) required for a full numerical font. The objective is to analyze the combinations of segment states required for this font and, while some display flexibility is lost by a less than full parallel configuration, reach a point in partial serialization at which useful characters would be eliminated by any further serialization. In addition, the configuration must avoid complicating the control configuration and must permit the control devices to shunt to a terminal common to all control devices and all display branches. For shunt control, we further assume energization of each branch from a substantially constant current source included in each branch, and that the control over each light emitting diode reduces the voltage across that light emitting diode to below the visible excitation level and diverts the current to an alternate path. An analysis of the font discloses that the segment f is never visible without the c segment also being visible. The foregoing discovery makes it possible to connect the diodes forming the c and f segments in series, with the diode f subject to the "inner" or one diode shunt control, and the diode c subject to the "outer" or two diode shunt control. This discovery precludes 32 unused characters, and eliminates one parallel current path. Further analysis of the required combinations of segment stages shows that the segment e is never visible without the segment d being visible. This discovery makes it possible to connect the diodes forming the e and d segments in series, with the diode e subject to the "inner" or one diode shunt control and the diode d subject to the "outer" or two diode shunt control. This discovery precludes 32 unused characters (of which 8 were precluded above) and eliminates a second current path. Further analysis of the required combinations of segment states shows that the segment d is never visible without segment a being visible. This discovery makes it possible to connect the diodes forming the a, d and e segments in series, with the diode e being subject to the "inner" or one diode shunt control, and the diode d being subject to the "intermediate" or two diode shunt control, and the diode a being subject to the "outer" or three diode shunt control. This discovery precludes additional unused characters and eliminates a third separate current path. Taken together, with three serially connected diodes in the first energization and control branch, two serially connected diodes in the second energization and control branch, and single diodes in each of the third and fourth energization and control branches, some 80 unused characters are precluded, permitting 48 characters, in which 11 characters required for a full numerical font are found. With the four part energization, three current paths of the seven conventionally used are eliminated, resulting in a 43% current saving for each full-font, shunt controlled seven segment display site.

The four branch energization and control network has a major advantage in current saving with only a minor disadvantage in brightness "modulation". The serial connection of two or three display segments occasions a change in the brightness of one display segment as the other serially connected segments are switched. Assuming a 15 volt supply and a 2 volt drop in each light emitting diode, the current supplied to a single diode in a single diode branch (i.e., $LED_g$) is stabilized by an impedance which has a voltage drop 6½ times as great as the diode voltage. This sets a brightness standard to which the other segments in other branches may be referenced. In the three diode branch, the voltage drop across the current stabilizing impedance is only 1½ times larger than the voltage drop of the three serially connected light emitting diodes. This indicates that the light output is likely to depart most from some standard level of brightness when the diodes in the longest series chain are switched. An assumption that the shunt switch has either a zero or an infinite resistance is unnecessarily severe. In the indicated configuration, employing FET shunt control devices, the "on" condition of the shunt device can be made to have a voltage drop in excess of one volt. Assuming 2 volt LEDs, a one volt drop in the shunt device halves the change in voltage applied to the branch when the first diode (e.g. $LED_e$ or $LED_f$) in the string is cut off. In the case of equal 1.3 volt saturation voltages for both inner and intermediate shunt control transistors of the three diode branch operated in FIG. 3 from a 15 volt supply, the variation in current is approximately 28%. The reference for that branch is one in which the first LED ($LED_f$) in the three diode series is off. When all three diodes are on, there is a drop in branch current of 7%. When a second diode ($LED_d$) goes off, there is an increase in current of 21%. Should higher saturation voltages be used in the intermediate or inner shunt control devices, the variance may be further reduced. Doubling of the saturation voltage of the intermediate shunt control device (to 2.6 volts) in this example reduces the variance to ±7%.

The foregoing assumptions used to estimate changes in brightness under different conditions are conservative and design freedom exists to reduce the effect, if necessary, to a desired level. For example, constancy in the voltage drop across the LEDs with increased current is assumed. In practice, the voltage drop in the light emitting diode increases as the current goes up, and tends to reduce the actual current increase in any remaining diode. Similarly, the voltage developed across a shunt switch has been assumed to be independent of current. The use of MOSFET switches "turned on" by a current-independent gate-to-source voltage bias greatly exceeding the threshold voltage results in an essentially resistive drain-to-source channel, thereby providing additional negative feedback for improved current stabilization. A second practical factor in reducing the effect of supply current variation on brightness is that the diodes may be operated near saturation. When near saturation, increases in current produce a less than proportional change in light output. A third mitigating factor is the subjective effect on the viewer as the change in "on/off" status of some segments within a display modulates the brightness of other segments (typically within the same character site) which remain "on" through the transition. (The worst examples of this interaction in the embodiment of FIG. 3 occur when the number displayed in incremented from 6 to 7 or from 7 to 8). Since the viewer is normally looking at the total display, any complete turn-on or turn-off of a segment registers as a new number. In the unlikely event that one's attention is concentrated on a single segment which will remain "on" through the transitions of interest, that attention will probably be diverted to a nearby segment as it turns "on" or "off". Thus, the significance of this brightness modulation does not rest primarily in the time-varying nature of the brightness of a single segment, but rather in the impact which this effect has on the range of segment brightnesses to be found at any instant within a single character and, less critically, within a complete display. As such, this effect is seriously detrimental only if it significantly aggravates the existing inequalities in brightness due to poor matching of LED characteristics and non-compensating ratio errors among current stabilizing means. If such a problem does not exist, resolution probably resides in better process control of LED fabrication procedures and/or tighter LED testing limits. Finally, in the event that a given circuit voltage (e.g. 15 volts) allows too great a variation in the brightness of individual segments, the circuit voltage may be increased, typically to 40 volts, without exceeding the voltage breakdown limits of conventional energization or control circuitry. The effects of a doubling or tripling of the circuit voltage are to bring about a reduction in the current variation of more than ½ or ⅔, respectively, and to correspondingly reduce the brightness variation. Since the LED circuit voltage is normally achieved by a dissipation technique, an increase in the voltage across the paralleled energization and control circuits in order to equalize the brightness of the individual segments produces no additional power dissipation. In fact, since the total current for a shunt controlled display is reduced while being drawn ultimately from the same ac line voltage, the power dissipation may be reduced by the same percentage as the current reduction with respect to comparable circuits.

The 43% current savings in an individual character site permits a single timer chip to control a four character display, and permits the unit to be powered by a lower power, transformerless, supply. The current requirement for four full digits is typically reduced from 90 to 50 milliamperes. The control circuit dissipation is reduced as well. When a segment is off, the heat dissipation in a control transistor is about 4.55 milliwatts (1.3 volts×3.5 milliamperes). In a conventional seven parallel circuit configuration, when all segments of a site are off, the dissipation is 32 milliwatts. Assuming a 12 hour display having 4 numerical sites, AM/PM indicators and colon, the total control circuit dissipation would be about 123 milliwatts. In the present four circuit configuration, when all segments of a site are off, the comparable dissipations approach 18 milliwatts per character, or typically, 68 milliwatts total. The very sizable reduction in current drain permits the combined power dissipation with the clock radio cabinet (including voltage dropping resistor dissipation, control circuit dissipation, display dissipation, current stabilizing resistor dissipation, radio IC dissipation and loudspeaker dissipation) to fall within the 7 watt maximum design preference. Assuming the conditions of the first embodiment, the 820 ohm resistance R1 produces a voltage drop of 43.5 volts at 53 milliamperes, and a dissipation of about 4.37 watts. In a conventional 93 milliampere configuration, a like voltage drop would occasion a dissipation of about 7.66 watts. The remaining dissipations in these examples are approximately 1.51 watts and 2.65 watts, respectively, for total respective cabinet dissipations of about 5.88 watts and 10.31 watts. This significantly reduced dissipation makes practical the replacement of the relatively expensive transformer-type power supply by the line dropping resistor-type supply.

In FIG. 4 a variant arrangement is described for providing the dc bias for the LED display. In this arrangement, additional voltage is provided for the display to reduce the variation in brightness of individual segments as different numbers are displayed. As before, the radio chip IC1 and the LED display board 26 are connected in series as a load across the dc supply, and the dc supply comprises a half wave rectifier $D_3$ and a series voltage dropping resistance $R_7$. A filter capacitor $C_3$ shunts the load. With an increase in values of the current stabilizing resistances of the LED display board, and a decrease in the value of the series voltage dropping resistance $R_7$, the voltage available to the LED display board 26 may be readily increased to 40 volts. This is the maximum voltage that the clock timer IC2 can be allowed to control, using devices made in the conventional p-MOS process. The clock timer IC2 is energized in shunt with the LED display board in a series circuit including the chip IC2, the resistance $R_8$, and the diode $D_4$. The hold up capacitor $C_4$ shunts the chip IC2. While the individual switching control connections are not shown, they may take the same form as illustrated in FIG. 3.

Figure 5:
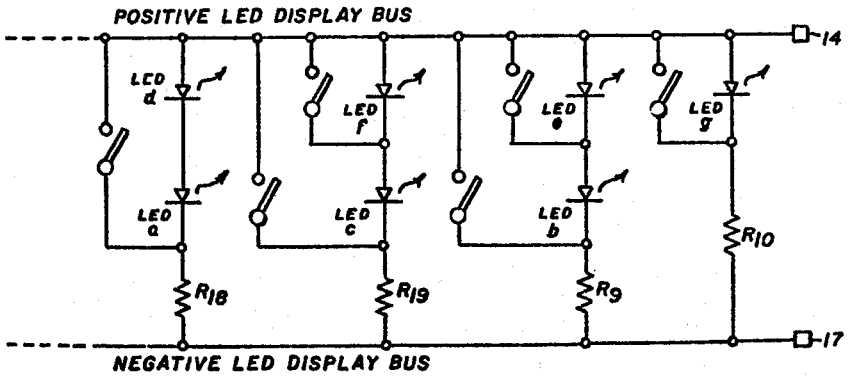
FIG. 5 is an electrical circuit diagram for part of a seven segment LED display which shows one character site capable of producing a 0 to 5 numerical font.

If a partial numeric font, possibly including a blank but not requiring any "six" or "seven", is desired, as for instance a 0–5 font, the LED configuration of FIG. 5 may be employed. A typical application of this partial font might be in a time display site dedicated to tens of minutes and/or tens of seconds. Here, the positive display bus is shown at 14 and the negative display bus is shown at 17. The light emitting diodes are connected in four paralleled circuits as before for energization and control, but the present arrangement differs in the distribution of the light emitting diodes and the omission of a control connection. In the first energization and control circuit, the light emitting diodes $LED_d$, $LED_a$, and a first current stabilizing resistance are connected in series in the order recited. In the second energization and control circuit, the light emitting diodes $LED_f$, $LED_c$ and a second current stabilizing resistance are similarly connected in series. In the third circuit, the light emitting diodes $LED_e$ and $LED_b$, and a third stabilizing impedance are similarly connected in series. In the fourth circuit, the light emitting diode $LED_g$ and a fourth current stabilizing impedance are connected in series. In the first circuit, there is no need to separately control the diode $LED_d$ to achieve the desired font, and the control connection may be eliminated. In the third circuit, the serial connection of the diodes $LED_e$ and $LED_b$ eliminates 32 possible characters (some of which are redundant with others already eliminated). The advantage of this configuration of reduced universality is that it provides a more uniform brightness at a given magnitude of voltage dropped across the current stabilizing impedance than a configuration that has three diodes in series.

Shunt switching, in which total display current is held approximately constant, is essential in a line operated transformerless system. The total current through one branch of the display, when a given display segment is on and its shunt control off, is held substantially equal to the total current through that branch when the display segment is off and its shunt device is on. While the change in voltage drop between a lighted LED segment and an "on" transistor shunt cannot be exactly zero, any current variation in that branch of the display is held to an acceptable minimum by design of the switching device or by use of a suitably large voltage drop across the current stabilizing resistance. If current in each branch is held constant, then that in the total display is held constant. If the total display current is not essentially constant, as with series switching of a parallel connected display, a fixed resistor in the power line is not a practical way to produce a desired display voltage because of the large current variation. In addition, without controlled display current, another load element, such as a radio IC, could not efficiently re-use the display current. Assuming a complete turn-off at the LEDs, as in a series switching arrangement, a 9 to 24 ratio of total display currents (i.e., between the times of 1:11 and 10:08) is produced in a conventional display even when such ratio-reducing constants as two colon dots always "on" and one of the AM/PM indicator dots always, "on" are considered. Such a current variation would be too large for practical re-use of the current in a serially connected radio IC.

Reducing the total current in the LED display by about 40% to a value which is compatible with the power-handling capability of a radio IC chip (e.g., 55 milliamperes) permits the two to be connected in series, and permits energization of the two by a single power supply consisting of a half wave rectifier using a voltage dropping resistor and a filter capacitor. The current drain in the LED display need not be exactly equal to that in the radio IC, since a low cost resistance can shunt one or the other to make up any small differences in current, particularly in the case of a radio IC lacking internal shunt voltage regulation. The current in the radio receiver is selected to hold power dissipated within the radio cabinet to about 5 watts. The unmodified LED display requires approximately 3.5 milliamperes per segment, 24 milliamperes per character, and approximately 100 millamperes for a four digit diaplay. This level of current is quite unacceptable for line cord operation and would produce a cabinet dissipation of over twelve watts. With an overall reduction in current of about 40%, attributable to the four path energization network and certain other current economies, the current in the LED display can be reduced to fit within the acceptable current range of a serially connected radio receiver. As a result, the heat previously dissipated in the series dropping resistance of the radio receiver is now dissipated in the LED display (including the energization and control circuitry), without increasing the total heat dissipation requirements of the cabinet. Since the normal design value of the radio IC supply current is 42 mA., a design trade-off exists wherein display brightness may be sacrificed for decreased dissipation. In the practical embodiment of FIG. 3, cabinet dissipation is allowed to increase toward the practical maximum in order to achieve maximum brightness.

The shunt control units may be of either p-type or n-type polarity, and may be either FET devices or bipolar transistors. In the FIG. 3 and FIG. 4 configurations, FET devices must have an adequately low "saturation" voltage when turned on to reduce the visibility of the light emitting diode to the desired unlit visibility. Duty cycling is preferred over other known compatible brightness control techniques for the FET embodiments described and allows the same shunt current amplitude regardless of brightness adjustment. With two volt LEDs, the "off" voltage is typically higher than 1.3 volts. With lower voltage LEDs, the "off" voltage may be lower. With serial branches, the saturation voltage of the shunt control circuit may be higher on the intermediate or outer contol connections, and still achieve an unlit state in the LEDs, particularly if, whenever overridden, each shunt control circuit is forced to be in its low conduction state. With bipolar transistors, the problem of excessive saturation voltage is normally not as severe as with FETs. If n-type control devices are employed, the circuit connections in the display circuit board may remain as before, but the polarity of the display buses should be inverted and the individual LEDs should each be kept in the same position, but with reversed connections.

While series resistors have been shown as the current stabilizing means in each branch of the display, it should be evident that active transistor current sources could also be employed. This causes some penalty in cost unless integrated in the clock timer IC chip.

The invention is also applicable to a 4×7 LED display producing a 0 to 9 numerical font. A common 0–9 font for the 4×7 display is illustrated in FIG. 6. The diodes of each character site are located at the intersections of a 4×7 matrix. Typically, there are twenty diodes and eight vacant intersections. The visual effect permitted by this number of diodes is to introduce a sense of curvature into certain of the numerical characters. The zero, for instance, by omission of the corners, appears to have a curved top and bottom. The curved effect is present in all of the numerals except the 1, 4 and 7.

A table of the diode states for a 0–9 numerical font for the 4×7 LED display is shown in FIG. 7A, with the diode positions being charted in FIG. 7B. Referring initially to FIG. 7B, it may be seen that the diodes are disposed about an elongated parallelogram having a horizontal bar. Assuming the position designations used for the seven segment displays discussed earlier, 14 diodes are located on the line segments a, b, c, d, e, f and g, and 6 diodes are located at numbered locations 1 to 6 where the lettered line segments adjoin. As illustrated, two diodes occupy each line segment and are designated $a_1$, $a_2$; $b_1$, $b_2$; $c_1$, $c_2$; $d_1$, $d_2$; $e_1$, $e_2$; $f_1$, $f_2$; $g_1$, $g_2$; respectively. One diode occupies each joint or "corner" and it is designated 1, 2, 3, 4, 5 and 6, respectively, proceeding clockwise around the parallelogram after starting in the upper right hand corner of the character. (In a 5×7 display, three diodes occupy each line segment.)

The diode states for each character of the 0–9 numerical font shown in FIG. 6 are indicated in FIG. 7A. Since the lettered diodes in the 4×7 display occupy the same positions that the lettered diode occupied in the seven segment display, it is plausible that the circuit serialization achieved by rulling out unnecessary states in the seven segment display can also be accomplished. The table of diode states is identical between the diode in position a, for example, of the seven segment display and the corresponding diodes $a_1$, $a_2$ also in position a of the 4×7 display. The fourteen diodes might, obviously, form the whole display, in which event the display would be an apparently curved approximation to the angularity of the segment display. Addition of the numbered diodes enhances readability significantly.

Further analysis of the table of FIG. 7A shows that the control for the numbered corner diodes can be profitably integrated with control for the lettered diodes. The diodes on segments a, d and e are essentially independent of the numbered diodes. On the other hand, diode 5 is never on without diodes $f_1$, $f_2$ being on. This implies that diode 5 may be connected in the inner position in a branch consisting of the current stabilizing resistance R12, diodes LED $c_2$, LED $c_1$, LED $f_2$, LED $f_1$, and $LED_5$. Since diode 2 is never on without diodes $b_1$, $b_2$ being on, they may also share a branch. The diodes on segment g require their own branch. The fact that diode 4 is never on unless diode 6 is on implies that the two may be connected in a single branch in which a current stabilizing resistance R15 and diodes $LED_6$ and $LED_4$ are serially connected. The remaining diodes $LED_1$ and $LED_3$ require separate branches.

A circuit diagram for the energization and control network for a 4×7 diode display is shown in FIG. 8. This circuit is capable of presenting the numerical font of FIG. 6. The circuit contains seven branches, in which the current stabilizing resistances are numbered respectively $R_{11}$ to $R_{17}$. In the first branch, although they could be serially connected, the diodes in each line segment are paralleled to reduce the supply voltage requirement. Since the devices on a line segment are paralleled, the current in that branch is double that in the other branches, and the sum of diode voltage drops tending to modulate the brightness of the a segment diodes is reduced to a range of from three diodes on to one diode on. The second branch has all five diodes connected in series so as to preserve a constant current in each member of the branch. The corresponding sum of diode voltage drops in this branch varies from 5 to 4 to 2 drops. The remainder of the configuration follows the same pattern, presenting a current drain of eight diodes, as opposed to twenty had there been fully paralleled energization.

While the principal embodiments of the invention have used light emitting diodes, it should be evident that the invention is also applicable to other light sources. In particular, those segmented incandescent displays which are designed to replace light emitting diodes may be used. Light emitting diodes are intrinsically low voltage devices relative to house main voltages (110-130 volts) and thus, in transformerless supplies, current conservation is essential to reasonable power dissipation. Individual LED segments at maximum brightness normally required voltages lying within the range of from 1.5 to 3.5 volts. This voltage corresponds to the forward voltage drop in a semiconductor junction (or two in series), slightly increased by the additional drop due to forward diode current flowing through the parasitic resistances in the device (or devices). The brightness in LED devices is approximately logarithmic, changing quite sharply at a "knee" typically above two-thirds of the normal operating voltage. These devices need not be forced to a zero voltage drop to reduce the brightness below the visible range, but, in most practical applications, only to a voltage in the vicinity of the "knee". The low "on" voltages and the relatively high "off" voltages permit LED devices to be stacked in series of up to five diodes without exceeding the maximum "off" voltage, or requiring unduly high conductances, respectively, of low cost, shunt connected IC switches. The currents of LED devices normally range from 0.6 milliamperes to 40 milliamperes dependent on diode size, segment size and desired segment brightness. In consumer products such as the clock radios partially depicted in FIG. 3 and FIG. 4, display cost is a very significant consideration. The display cost reduction afforded to the calculator manufacturers by means of decreased character height is not available to the producer of clock radios because the normal viewing distance is so much greater. Since decreased diode size tends to reduce both display cost and current drain, clock radios normally use diodes which are much smaller than the segments which they illuminate. The decreased maximum segment brightness which results is acceptable primarily because of the relatively low ambient light level characteristic of a typical clock radio operating environment, a notable exception being the strong lighting often associated with point-of-sale demonstrations. Inexpensively available, high-efficiency light emitters such as the 3.5 milliampere GaAsP diodes assumed in FIG. 3 and FIG. 4 adequately satisfy the desire for increased brightness within the cost constraints of this product market. When LED devices having 3.5 milliampere currents are employed, a good current match is found between a four character clock timer display and a 50 milliampere radio chip, and the two may be serially connected as earlier discussed. When a given segment current level and maximum brightness are desired, the present configuration can be used to reduce the total current drain by the 40% earlier mentioned over that of full parallel energization. This, in effect, permits use of a brighter LED display (or one having the same brightness but usingless efficient diodes) when the current drain is fixed.

When LED devices are replaced by incandescent devices, the same considerations apply. The incandescent devices, designed for LED replacement, should be of appropriately low voltages to permit five-unit stacking without exceeding the breakdown voltages of conventional semiconductor switching devices. Furthermore, in applications requiring a full-range brightness control, they should have a strongly non-linear brightness versus voltage characteristic, so that they can be turned off with relatively "poor" shunt switches. The present inventive configuration permits the current of such a display to be reduced 40%, thereby allowing a corresponding decrease in the net dissipation of a transformerless supply. Conversely, it permits the brightness to be greatly increased within the limits of the available current in transformerless supplies. This increase in brightness may be used for improved contrast in high ambient light level situations. In applications which cannot benefit significantly from increased brightness, the unlimited color filter selection made possible by the wideband nature of the incandescent output spectrum combined with the excess brightness required to compensate for filter absorption provide a saleable package in the consumer market place, where alternate display color choices are valued.

What is claimed as new and desired to be secured by Letters Patent of the United States is:

1. The combination comprising:

(1) a controllable numerical display site containing a plurality of light emitting diodes at positions "a" to "g" respectively, on a vertically elongated parallelogram with a central horizontal bar, said positions being identified as follows:

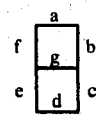

(2) a diode energization and control network comprising:

A. polarized first and second input terminals for connection to a source of unidirectional potential, and B. a plurality of mutually parallel energization and control branches connected between said input terminals, and each including a current stabilizing means, one or more forward poled diodes, and one or more switches each returned to said second input terminal, (a) said first branch including:

(1) a first current stabilizing means and diodes in said positions a and d connected respectively between said first and said second input terminals, and (2) a first switch shunting said diodes in positions a and d, whereby a diode in position d is never on without a diode on in position a, (b) said second branch including:

(1) a second current stabilizing means and diodes in said positions c and f connected respectively between said first and said second input terminals, and (2) two switches: one, a second switch shunting said diodes in positions c and f, and the other, a third switch, shunting said diode in position f, whereby a diode in position f is never on without a diode on in position c, (c) said third branch including:

(1) a third current stabilizing means and a diode in said position b connected respectively between said first and said second input terminals, and (2) a fourth switch shunting said diode in position b, and (d) said fourth branch including:

(1) a fourth current stabilizing means and a diode in position g connected respectively between said first and said second input terminals, and (2) a fifth switch shunting said diode in position g.

2. The combination comprising:

(1) a controllable site capable of displaying, singly, numerals representing the integer numbers 0 to 5, and containing a plurality of light emitting diodes at positions "a" to "g" respectively, on a vertical elongated parallelogram with a central horizontal bar, said positions being identified as follows:

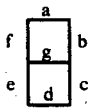

(2) a diode energization and control network comprising:

A. polarized first and second input terminals for connection to a unidirectional source, and B. a plurality of mutually parallel energization and control branches connected between said input terminals, and each including a current stabilizing means, one or more forward poled diodes, and one or more switches each returned to said second input terminal, (a) said first branch including:

(1) a first current stabilizing means and diodes in said a and d positions connected respectively between said first and said second input terminals, and (2) a first switch shunting said diodes in positions a and d, whereby a diode in position d and a diode in position a are on or off together, (b) said second branch including:

(1) a second current stabilizing means and diodes in said positions c and f connected respectively between said first and said second input terminals, and (2) two switches: one, a second switch shunting said diodes in positions c and f, and the other, a third switch shunting said diode in position f, whereby a diode in position f is never on without a diode on in position c, (c) said third branch including:

(1) a third current stabilizing means and diodes in said positions b and e connected respectively between said first and said second input terminals, and (2) two switches: one, a fourth switch, shunting said diodes in positions b and e, and the other, a fifth switch, shunting said diode in position e, whereby a diode in position e is never on without a diode on in position b, and (d) said fourth branch including:

(1) a fourth current stabilizing means and a diode in said position g connected respectively between said first and said second input terminals, and (2) a sixth switch shunting said diode in position g.

3. The combination comprising:

(1) a controllable site capable of displaying, singly, numerals representing the integer numbers 0 to 9, and containing a plurality of discrete light sources at positions "a" to "g" respectively, on a vertically elongated parallelogram with a central horizontal bar, said positions being identified as follows:

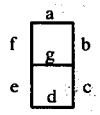

(2) an energization and control network for said light sources, comprising:

A. polarized first and second input terminals for connection to a unidirectional source, and B. a plurality of mutually parallel energization and control branches connected between said input terminals, and each including a current stabilizing means, one or more discrete light sources, and one or more switches each returned to said second input terminal, (a) said first branch including:

(1) a first current stabilizing means and light sources in said positions a, d and e connected respectively between said first and said second input terminals, and (2) three switches, the first switch shunting said light sources in positions a, d and e, the second switch shunting said light sources in positions d and e, and the third switch shunting said light source in position e, whereby a light source in position e is never on without a light source on in position d, and a light source in position d is never on without a light source on in position a, (b) said second branch including:

(1) a second current stabilizing means and light sources in said positions c and f connected respectively between said first and said second input terminals, and (2) two switches: one, a fourth switch shunting said light sources in positions c and f, and the other, a fifth switch, shunting said light source in position f, whereby a light source in position f is never on without a light source on in position c, (c) said third branch including:

(1) a third current stabilizing means and a light source in said position b connected respectively between said first and said second input terminals, and (2) a sixth switch shunting said light source in position b, and (d) said fourth branch including:

(1) a fourth current stabilizing means and a light source in said position g connected respectively between said first and said second input terminals, and (2) a seventh switch shunting said light source in position g.

4. The combination set forth in claim 3 wherein each light source includes a light emitting diode poled for maximum conduction.

5. The combination set forth in claim 4 wherein there is one diode capable of producing light in a rod-like shape in each position.

6. The combination set forth in claim 4 wherein there are at least two forward-poled diodes in each position.

7. The combination set forth in claim 3 wherein (1) said plurality of discrete light sources also includes a diode at each numbered position on said parallelogram identified as follows:

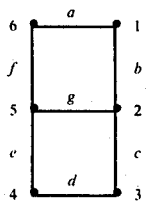

(2) said second branch also including:

(i) a diode in said position 5 connected in series between said light source in position f and said second input terminal, and (ii) said fourth switch shunting light sources in positions c, f and 5, said fifth switch shunting light sources in positions f and 5, and having an eighth switch shunting said diode in position 5, whereby a diode in position 5 is never on without a light source on in position f, and a light source in position f is never on without a light source on in position c, (3) said third branch also including:

(i) a diode in said position 2 connected in series between said light source in position b and said second input terminal, and (ii) said sixth switch shunting light sources in positions b and 2, and having a ninth switch shunting said diode in position 2, whereby a diode in position 2 is never on without a light source on in position b, and having (4) a fifth branch including:

(i) a fifth current stabilizing means and diodes in said positions 6 and 4 connected respectively between said first and second input terminals, and (ii) a tenth switch shunting said diodes in positions 6 and 4, and an eleventh switch shunting said diode in position 4, whereby a diode in position 4 is never on without a diode on in position 6, (5) a sixth branch including:

(i) a sixth current stabilizing means and a diode in said position 1 connected respectively between said first and said second input terminals, and (ii) a twelfth switch shunting said diode in position 1, and (6) a seventh branch including:

(i) a seventh current stabilizing means and a diode in said position 3 connected respectively between said first and said second input terminals, and (ii) a thirteenth switch shunting said diode in position 3.

8. The combination set forth in claim 7 wherein there are at least two diodes in each lettered position.

* * * * *